US005258055A

United States Patent [19]

Pargeter et al.

[11] Patent Number: 5,258,055

[45] Date of Patent: Nov. 2, 1993

[54] PROCESS AND SYSTEM FOR RECOVERING ZINC AND OTHER METAL VAPORS FROM A GASEOUS STREAM

[75] Inventors: John Pargeter, Voorhees, N.J.; David T. Bunney, Jackson, Tenn.

[73] Assignee: International Mill Service, Inc., Horsham, Pa.

[21] Appl. No.: 938,098

[22] Filed: Aug. 31, 1992

[51] Int. Cl.[5] ..... C22B 19/04

[52] U.S. Cl. ..... 75/665; 75/669; 75/694

[58] Field of Search ..... 75/658, 659, 663–667, 75/694, 669, 10.3, 10.31, 10.32; 266/146, 147, 150

[56] References Cited

U.S. PATENT DOCUMENTS

| | | | |
|---|---|---|---|
| 1,030,676 | 6/1912 | Moulden et al. | 75/664 |
| 1,712,133 | 2/1927 | Breyer . | |
| 1,790,012 | 5/1925 | Mahler et al. . | |
| 1,871,657 | 8/1928 | Bunce . | |
| 1,873,861 | 8/1932 | Bunce . | |
| 1,962,440 | 10/1929 | Ginder et al. . | |
| 2,048,863 | 4/1933 | Handwerk et al. . | |
| 2,381,405 | 8/1945 | Griswold, Jr. . | |
| 2,457,544 | 11/1945 | Handwerk et al. . | |
| 2,457,545 | 11/1945 | Handwerk et al. . | |
| 2,457,546 | 12/1945 | Hardwerk et al. . | |
| 2,457,547 | 12/1945 | Hardwerk et al. . | |
| 2,457,548 | 6/1946 | Handwerk et al. . | |
| 2,457,550 | 12/1948 | Mahler et al. . | |
| 2,457,551 | 12/1948 | Robson . | |
| 2,457,552 | 12/1948 | Handwerk et al. . | |
| 2,492,438 | 12/1949 | Peirce . | |
| 2,494,551 | 1/1950 | Handwerk et al. . | |
| 2,494,552 | 1/1950 | Mahler et al. . | |
| 2,637,649 | 5/1953 | Hardwerk et al. . | |
| 3,512,959 | 5/1970 | Joseph et al. . | |
| 3,667,934 | 6/1972 | Derham et al. . | |
| 3,823,013 | 7/1974 | Lawrence . | |
| 3,841,862 | 10/1974 | Benatt et al. | 75/669 |
| 4,080,197 | 3/1978 | Meissner et al. | 75/694 |
| 4,295,884 | 10/1981 | Hicter et al. . | |
| 4,325,539 | 4/1982 | Hicter et al. . | |
| 4,963,182 | 10/1990 | Bishop et al. | 75/669 |

*Primary Examiner*—Melvyn J. Andrews

*Attorney, Agent, or Firm*—Dann, Dorfman, Herrell and Skillman

[57] ABSTRACT

A process is provided for condensing zinc and other metal vapors from a gaseous stream. A duplex condensing bath is provided, having a bottom layer of molten zinc and a top layer comprising a liquid condensing medium, such as a molten salt. The molten salt is inert to, immiscible with, and less dense than the molten zinc, and has a negligible zinc vapor pressure even at temperatures greater than 700° C. The molten salt condensing medium is splashed into, or otherwise contacted with the gaseous stream, causing condensation of the zinc and other metal vapors, which then partition with the molten zinc layer of the duplex condensing bath.

The process of the present invention is a significant improvement over current molten zinc-type splash condenser systems. The negligible zinc vapor pressure of the molten salt layer permits operating temperatures of 700° C. or more, thereby increasing the efficiency of vapor recovery by limiting the detrimental oxide-forming back reactions that occur at lower operating temperatures.

24 Claims, 1 Drawing Sheet

PROCESS AND SYSTEM FOR RECOVERING ZINC AND OTHER METAL VAPORS FROM A GASEOUS STREAM

FIELD OF THE INVENTION

This invention relates to the recovery of zinc and other metal vapors and, more particularly, to a process and system for condensing zinc and other metal vapors from a gaseous stream.

BACKGROUND OF THE INVENTION

Processes to recover zinc and lead from naturally occurring ores containing both of those metals have long been established. A typical process, known as the "Imperial Smelting Process" (ISP), comprises three major steps. The first step is a travelling grate sintering step used to convert mixed sulfide ores containing zinc sulfide (ZnS), lead sulfide (PbS) and cadmium sulfide (CdS) to oxides. In the second step, the oxide sinter is mixed with coke and fluxes and treated in a short shaft blast furnace to produce a slag and top gas containing zinc, lead, cadmium and carbon monoxide gases.

In the third step, the metallic vapors contained in the top gas are recovered from a gaseous stream in a splash condenser. It is the condensing step that is of interest in the present application, as the invention is directed toward a condensing process and apparatus.

In the typical condensing process, top gases are passed from the blast furnace to the condenser at a temperature of at least 1100° C., which is about 200° C. above the boiling point of zinc (907° C.). The condenser consists of a chamber partially filled with molten zinc, into which are immersed one or more impeller type splashes. The impellers throw a storm of zinc droplets into the gas stream as it passes through the condensing chamber. The molten zinc bath is maintained at a temperature of about 500° C. Because of the temperature differential between the zinc bath and the gaseous stream, the droplets act to shock-cool the gas stream to a temperature very near that of the zinc bath, causing the zinc vapor in the gas stream to condense to a liquid phase. The liquid zinc then falls to the zinc bath, which gradually increases in volume and is tapped to produce marketable product forms.

The efficacy of the molten zinc condensing process is limited by the physical and thermochemical properties of zinc. The first limitation is imposed by the vapor pressure of zinc. The element zinc has a very narrow range between its melting and boiling points (419° and 907° C., respectively). For this reason, zinc has a significant vapor pressure at any temperature over the melting point. This feature negatively impacts the ability of a zinc splash condenser to condense zinc from the gas stream.

To illustrate the vapor pressure limitation, suppose a gas stream enters the condenser at 1100° C. and contains 20% vapor by volume. The zinc pressure in the gas stream is therefore 0.2 atmospheres. The action of the zinc splash in the condenser cools the gas stream to about 700° C. (approximately 200° C. under the zinc boiling point). Though it might be expected that the zinc gas would condense and become liquid at 700° C., this does not occur because the zinc vapor pressure existing over a bath of molten zinc at 700° C. is 0.65 atmospheres. Because the incoming gas stream contains only 0.2 atmospheres of zinc, the zinc condensing medium would vaporize and leave the system, resulting in a net loss of condensed zinc, rather than the desired net gain.

The limitations imposed by vapor pressure considerations dictate that, at equilibrium, the condensation of zinc from a 20% zinc gas stream will not reach 90% efficiency until the operating temperature of the condenser is lowered below 500° C. For this reason, molten zinc splash condensers are routinely operated at below 500° C.

The necessity of operating a molten zinc splash condenser at below 500° C. introduces a second limitation on the condensing process, relating to the reduction of the metal oxides formed in the blast furnace or smelter. The zinc-bearing gases destined for treatment in the splash condenser are generated by the carbothermic reduction of zinc oxides, according to the following reaction:

$$ZnO + C \rightarrow Zn + CO \quad (1)$$

Although Reaction 1 is the significant reaction in the zinc recovery process, taking place at elevated temperatures, other reactions are possible under such conditions:

$$ZnO + CO \rightleftharpoons Zn + CO_2 \quad (2)$$

$$C + CO_2 \rightleftharpoons CO \quad (3)$$

The latter two reactions are reversible and can proceed in either direction, depending on operating conditions. However, because of Reaction 2, and others such as:

$$FeO + CO \rightarrow Fe + CO_2 \quad (4)$$

and $$PbO + CO \rightarrow Pb + CO_2 \quad (5)$$

some carbon dioxide will always be present in the reaction system. The presence of carbon dioxide enables zinc oxide (ZnO) to be formed by the back reaction of equation (2). This back reaction clearly defeats the purpose of the entire operation, the objective of which is to form reduced zinc. Thus, the Imperial smelting process, and other condensing processes of a similar nature teach toward operating modes which minimize the impact of the back reaction. But because the back reaction is favored by decreased temperature, its negative impact is increased as the condenser operating temperature is lowered. Thus, operating temperatures of under 500° C., which are necessary to minimize zinc vapor pressure limitations, will favor the back reaction, thus decreasing the yield of reduced zinc. For example, the possible recovery of zinc from a gaseous stream containing 20% zinc by volume is about 85% at 500° C. based on vapor pressure considerations. However, at this temperature the back reaction (2) is so strongly favored that 30% of the zinc is lost as oxide.

To minimize the problems caused by vapor pressure and thermochemical factors, the following condenser operation procedures have generally been followed. First, the incoming gas stream is made as rich in zinc vapor as possible, and contains CO and $CO_2$ in a ratio of at least 100:1. Second, the zinc condenser is operated at 480° C. Third, contact between the zinc splash and the incoming gas stream is maximized to cool the gas stream to 480° C. as rapidly as possible, which limits the time during which the back reaction can occur.

Even if the above-identified condenser operation procedures are employed, the thermodynamic and chemical limitations of the process significantly restrict the efficiency with which zinc may be recovered from a gas stream. Clearly, a method is needed for increasing the efficiency of zinc recovery.

The typical zinc condensing system could be vastly improved in efficiency by any modification that could: (1) enable operation of a condenser system at a higher temperature, thereby restricting the back reaction; or (2) restrict the back reaction at the lower operating temperature by some other means. Neither such method is currently available for use in a molten zinc-type splash condenser.

SUMMARY OF THE INVENTION

In accordance with the present invention, a process is provided for condensing zinc and other metal vapors from a gaseous stream at a pre-determined process temperature. The process comprises providing a duplex condensing bath which has a bottom layer of molten zinc and a top layer comprising a liquid condensing medium. The liquid condensing medium is inert to, immiscible with, and less dense than the molten zinc, and it has a negligible zinc vapor pressure at the process temperature, which preferably comprises a condensing bath temperature of 700° C. or greater. The gaseous stream comprising zinc and other metal vapors, such as lead and cadmium, is contacted with the liquid condensing medium under conditions which cause condensation of the metal vapors from the gaseous stream.

According to one aspect of the invention, the liquid condensing medium comprises a molten salt. In a preferred embodiment, the molten salt is a halide salt, preferably a mixture of NaCl and KCl.

The duplex condensing bath is maintained at a temperature above the melting point of the condensing medium and below the boiling point of the molten zinc in the bath, generally between 600° C.– 800° C. In a preferred embodiment, the duplex condensing bath is maintained at about 700° C.

Thus, in a preferred embodiment, the gaseous stream is contacted with the molten salt mixture under conditions causing condensation of the zinc and other vapors to a liquid phase. This results in the partitioning of the condensed zinc and other metals with the molten zinc comprising the bottom layer of the duplex condensing bath, thereby increasing the volume of the molten zinc layer in the duplex condensing bath. The condensed zinc is collected by removing the increased volume of molten zinc from the condensing bath, thereby recovering the zinc and other condensed metals from zinc and other vapors disposed within the gaseous stream.

According to another aspect of the present invention, a molten salt condensing system for recovering zinc and other metal vapors from a gaseous stream is provided. The system comprises a chamber having an inlet and an outlet, which enables the gaseous stream to pass through the chamber, and a reservoir contained within the chamber. The reservoir contains a duplex condensing bath which comprises a bottom layer of molten zinc and a top layer of molten salt. There is also provided a contacting means for contacting the molten salt with the gaseous stream passing through the chamber. This contacting causes condensation of the zinc and other metal vapors to a liquid phase, resulting in partitioning of the condensed zinc and other metals with the molten zinc comprising the bottom layer of the duplex condensing bath. The volume of the molten zinc layer is thereby increased, and a means is provided for collecting the condensed zinc and other condensed metals from the molten zinc layer of the duplex condensing bath. The collected zinc and other condensed metals are separated from one another according to standard methods.

The process of the present invention provides significant advantages over methods currently available for recovering zinc from smelter top gases. The molten salt layer provides a condensing medium having a negligible zinc vapor pressure at the process temperature, thereby enabling operation of the condensing bath at a much higher temperature, which greatly limits the detrimental effect of the back reaction of equation (2), which forms oxides of the zinc and other metals. This feature allows a much greater efficiency of zinc recovery, as well as recovery of zinc and other metal vapors from top gases containing relatively low percentages of these vapors.

BRIEF DESCRIPTION OF THE DRAWINGS

The foregoing summary, as well as the following description of preferred embodiments of the present invention, will be better understood when read in conjunction with the appended drawings in which.

DETAILED DESCRIPTION

In accordance with the present invention, the physical and thermochemical limitations of the molten zinc splash condenser are overcome by the use of an alternative cooling and condensation medium in place of molten zinc. The condensing chamber contains a duplex bath comprising, as a top layer, a liquid condensing medium that is inert to, immiscible with, and less dense than the molten zinc, and has a negligible zinc vapor pressure at temperatures of 700° C. or greater. The liquid condensing medium floats on a bottom layer of molten zinc.

In a preferred embodiment, the liquid condensing medium comprises a molten salt or mixture of salts, such as KCl and NaCl. The vapor pressure of zinc over such a bath is miniscule, estimated at less than 0.004 atmospheres even at temperatures as high as 707° C. Thus, the theoretical collection efficiency of a condenser operating at 707° C., with a 20% zinc (by volume) incoming gas stream is increased from 0% to 98%. Because zinc is insoluble in condensing media such as the molten salts described above, the bath may be operated at even higher temperatures. In fact, temperatures approaching the zinc boiling point could be employed. The ability to operate at temperatures of 700° C. or higher has a significant positive impact of limiting the extent of the back-reaction (2), thereby reducing the sensitivity to carbon dioxide in the process gas stream. This allows zinc to be collected with little or no ZnO formation at $CO_2/CO$ ratios as high as 5:1.

In a preferred embodiment, the duplex bath is prepared by melting a salt and placing it on top of a bath of molten zinc. The molten salt bath may comprise halide salts of $Na^+$, $K^+$, $Ca^{++}$, $Mg^{++}$, $Li^+$, and the like. In a particularly preferred embodiment, a salt mixture comprising NaCl and KCl is utilized. Preferably, NaCl comprises 20–80% of the mixture, with KCl comprising the remainder of the mixture.

The duplex bath is held in a suitable chamber through which is passed a gaseous stream containing Zn, Pb, Cd, CO, $CO_2$ and other gases and vapors. The molten bath is kept at a temperature above the mixed salt melting point (e.g., over 700° C. for the NaCl/KCl mixture). The melting point of the molten salt mixture may be adjusted by addition or substitution of the other halide salts mentioned above.

The molten salt is splashed or sprayed into the gas stream, causing condensation of the zinc and other metal vapors to a liquid phase, which partitions with the molten zinc layer of the duplex condensing bath. As the bath increases in volume, molten zinc is removed, and the condensed metals are separated using standard procedures.

Figure 1:
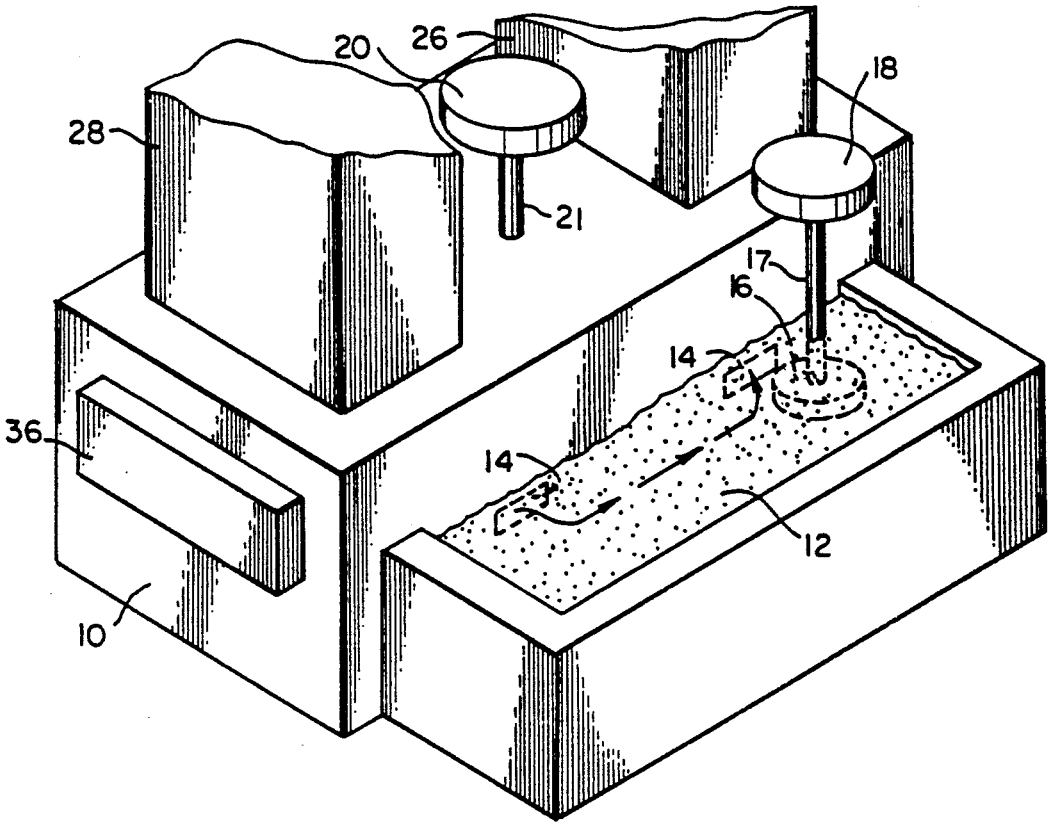
FIG. 1 is a schematic perspective view of a splash condensing system for performing the process of the present invention.
Figure 2:
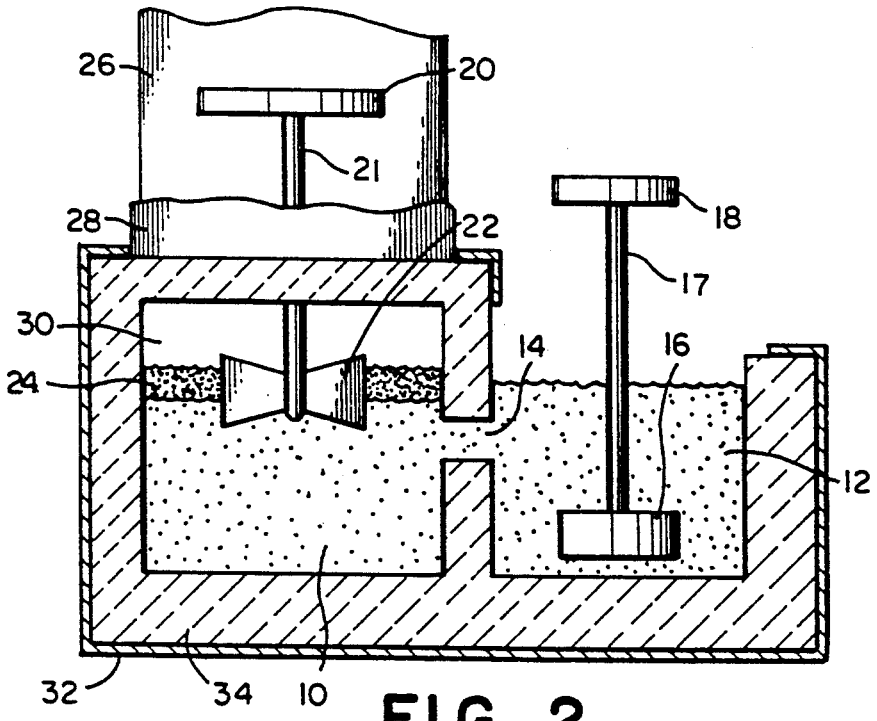
FIG. 2 is a schematic cross-sectional view taken through the forward portion of the splash condensing system illustrated in FIG. 1.

The process of the present invention may be embodied in any of the zinc-lead splash recovery systems commonly utilized in the industry. A schematic diagram of such a system for recovering zinc is depicted in FIGS. 1 and 2. Referring to FIGS. 1 and 2, a splash condenser useful for practicing the present invention may comprise a generally rectangular condensing chamber 10 having a vapor inlet duct 28 proximate to one end of the chamber and a gas outlet duct 26 for exhaust gases proximate to the other end of the chamber. The condensing chamber is lined with suitable refractory material 34 and encased in a steel support 32. The condensing chamber may be fitted with a clean-out box 36 for draining and cleaning the system. The system also comprises an outer vessel or chamber 12 through which molten metal may flow through connnecting ports 14, thereby allowing molten zinc to be removed from the system so as to maintain a substantially constant volume of the molten metal in the main chamber. The main chamber 10 and the outer chamber or vessel 12 are filled with sufficient molten zinc to immerse connecting ports 14. Zinc is recirculated from the main chamber to the outer chamber and back through connecting ports 14, by means of a recirculating pump 16 connected by a shaft 17 to a pump drive 18. The flow of zinc from the main chamber to the outer chamber is indicated in FIG. 1 by the arrows between connecting ports 14. The main chamber 10 contains a duplex condensing bath which comprises molten zinc overlayed by a substantially lesser volume of the molten salt solution 24. Splashing of a molten salt solution is accomplished by means of an impeller-type splashing apparatus 22, connected to splash drive 20 by shaft 21.

It may be seen, accordingly, that the zinc vapor-bearing gases are introduced to the main chamber through vapor inlet duct 28, and flow from one end of the main chamber to the other end through gas space 30, to be exhausted through the gas outlet duct 26. The gaseous stream is contacted with the molten salt 24 by splashing salt droplets into the gaseous stream by means of the splashing apparatus 22. Droplets containing zinc and other metals then fall into the bath, where the higher density metals partition with the molten zinc in the duplex bath, thereby increasing the total volume of the zinc bath in the main chamber. The excess molten metal in the main chamber adds to the overall volume of the molten zinc layer, and may be recovered from the splash condensing system by removal from the outer chamber 12.

The process of the present invention provides several additional advantages over currently used processes for recovering zinc and other metal vapors. For example, liquid condensing media such as molten salts provide a much better splash medium than zinc or other metals, due to the low viscosity and density of the salt. The salts are also far less corrosive than molten zinc. These factors allow the condenser to be constructed in a wide variety of specifications. Moreover, contact between the molten salt and the gas stream may be made in a variety of ways, e.g., by use of a splasher, or by spray heads, or even by bubbling the gaseous stream through the molten salt.

In addition, many gaseous streams, particularly those generated by direct smelting of electric arc furnace steel-making dust contain gaseous sodium, potassium, chlorine and fluorine in appreciable amounts (up to 7% by volume). Condensing processes employing the traditional molten zinc condensing medium are negatively impacted by these elements because they condense in the splash chamber, forming a sticky mixture. This mixture combines with the naturally occurring zinc oxide dross to form a voluminous mass which interferes with the splash action, entrapping the zinc and eventually choking the system. In the process of the invention, however, these elements are readily incorporated into the molten salt bath, and any excess can be easily tapped off through a suitable drain.

While certain aspects of the present invention have been described above as preferred embodiments, various other embodiments should be apparent to those skilled in the art from the foregoing disclosure. The present invention, therefore, is not limited to the embodiments specifically described above, but is capable of variation and modification within the scope of the appended claims.

What is claimed is:

1. A process for condensing metal vapors from a gaseous stream at a pre-determined process temperature, comprising the steps of:

a) providing a duplex condensing bath having a bottom layer of molten zinc and a top layer comprising a liquid condensing medium, said condensing medium being inert to, immiscible with, and less dense than said molten zinc, and having a negligible vapor pressure for said metal vapors at said process temperature; and b) contacting said gaseous stream with said liquid condensing medium, under conditions causing condensation of said metal vapors from said gaseous stream.

2. A process according to claim 1, wherein said metal vapors are selected from the group consisting of zinc, lead and cadmium.

3. A process according to claim 1, wherein said process temperature comprises a duplex bath temperature between about 600° C. and about 800° C.

4. A process according to claim 3, wherein said duplex bath temperature is about 700° C.

5. A process according to claim 1, wherein said liquid condensing medium comprises molten salt.

6. A process according to claim 5, wherein said molten salt is a halide salt comprising a counter-ion selected from the group consisting of $Na^+$, $K^+$, $Ca^{++}$, $Mg^{++}$, $Li^+$or a mixture thereof.

7. A process according to claim 6, wherein said molten salt comprises a mixture of NaCl and KCl.

8. A process according to claim 7, wherein said molten salt mixture comprises 20–80% NaCl, with KCl comprising the remainder of said mixture.

9. A process according to claim 1, wherein said metal vapors are contacted with said liquid condensing medium by splashing said liquid condensing medium into said gaseous stream.

10. A process according to claim 1, wherein said metal vapors are contacted with said liquid condensing medium by spraying said liquid condensing medium into said gaseous stream.

11. A process according to claim 1, wherein said metal vapors are contacted with said liquid condensing medium by bubbling said gaseous stream through said liquid condensing medium.

12. A process for recovering zinc and other metal vapors by condensing said vapors from a gaseous stream at a pre-determined process temperature, said process comprising the steps of:

a) providing a duplex condensing bath having a bottom layer of molten zinc and a top layer comprising a liquid condensing medium, said liquid condensing medium being inert to, immiscible with, and less dense than said molten zinc, and having a negligible zinc vapor pressure at said process temperature;

b) contacting said gaseous stream with said liquid condensing medium under conditions causing condensation of said zinc and other metal vapors to a liquid phase, said condensation resulting in partitioning of said condensed zinc and other metals with said molten zinc comprising the bottom layer of said duplex condensing bath, thereby increasing the volume of said molten zinc layer in said duplex condensing bath;

c) collecting said condensed zinc and other metals by removing said increased volume of molten zinc from said duplex condensing bath; and d) separating said condensed metals from one another, thereby recovering said zinc and other metal vapors from said gaseous stream.

13. A process according to claim 12, wherein said other metal vapors are selected from the group consisting of lead and cadmium.

14. A process according to claim 12, wherein said process temperature comprises a duplex bath temperature of between about 600° C. and about 800° C.

15. A process according to claim 14, wherein said duplex bath temperature is about 700° C.

16. A process according to claim 12, wherein said liquid condensing medium comprises molten salt.

17. A process according to claim 16, wherein said molten salt is a halide salt comprising a counter-ion selected from the group consisting of $Na^+$, $K^+$, $Ca^{++}$, $Mg^{++}$, $Li^+$or a mixture thereof.

18. A process according to claim 17, wherein said molten salt comprises a mixture of NaCl and KCl.

19. A process according to claim 18, wherein said molten salt mixture comprises 20–80% NaCl, with KCl comprising the remainder of said mixture.

20. A process according to claim 12, wherein zinc and other metal vapors are contacted with said liquid condensing medium by splashing said liuquid condensing medium into said gaseous stream.

21. A process according to claim 12, wherein said zinc and other metal vapors are contacted with said liquid condensing medium by spraying said luiquid condensing medium into said gaseous stream.

22. A process according to claim 12, wherein said zinc and other metal vapors are contacted with said liquid condensing medium by bubbling said gaseous stream through said liquid condensing medium.

23. A condensing system for recovering zinc and other metal vapors from a gaseous stream, said condensing system comprising:

a) a chamber having an inlet and an outlet for said gaseous stream, thereby enabling said gaseous stream to pass through said chamber;

b) a reservoir contained within said chamber, said reservoir comprising a duplex condensing bath for condensing said zinc and other metal vapors from said gaseous stream, said condensing bath having a bottom layer of molten zinc and a top layer of molten salt;

c) a contacting means for contacting said molten salt with said gaseous stream passing through said chamber, said contacting causing condensation of said zinc and other metal vapors to form condensed zinc and other condensed metals, said condensation resulting in partitioning of said condensed zinc and other condensed metals with said molten zinc comprising the bottom layer of said duplex condensing bath; and d) a collecting means for collecting said condensed zinc and other condensed metals from said molten zinc layer of said duplex condensing bath.

24. A condensing system for condensing zinc vapor from a gaseous stream, which comprises:

a) a chamber having an inlet and an outlet for said gaseous stream, thereby enabling said gaseous stream to pass through said chamber;

b) a reservoir contained within said chamber, said reservoir comprising a duplex condensing bath for condensing said zinc vapor from said gaseous stream, said condensing bath having a bottom layer of molten zinc and a top layer of molten salt;

c) a contacting means for contacting said molten salt with said gaseous stream passing through said chamber, said contacting causing condensation of said zinc vapor to form condensed zinc, said condensed zinc partitioning with said molten zinc comprising the bottom layer of said duplex condensing bath; and d) a collecting means for collecting said condensed zinc from said molten zinc layer of said duplex condensing bath.

* * * * *